US007793864B2

(12) United States Patent
Decarne et al.

(10) Patent No.: US 7,793,864 B2
(45) Date of Patent: Sep. 14, 2010

(54) DEVICE FOR SPRAYING A LIQUID

(75) Inventors: Patrick Decarne, Octeville sur Mer (FR); Jean-Jacques Serin, Octeville sur Mer (FR)

(73) Assignee: Sidel Participations, Octeville sur Mer (FR)

( * ) Notice: Subject to any disclaimer, the term of this patent is extended or adjusted under 35 U.S.C. 154(b) by 0 days.

(21) Appl. No.: 12/096,821

(22) PCT Filed: Nov. 28, 2006

(86) PCT No.: PCT/FR2006/002606

§ 371 (c)(1),
(2), (4) Date: Jul. 8, 2008

(87) PCT Pub. No.: WO2007/080243

PCT Pub. Date: Jul. 19, 2007

(65) Prior Publication Data

US 2008/0277500 A1 Nov. 13, 2008

(30) Foreign Application Priority Data

Dec. 15, 2005 (FR) ..... 05 12778

(51) Int. Cl.
*B05B 3/04* (2006.01)

(52) U.S. Cl. ..... 239/237; 239/225.1; 239/240; 239/548; 239/556; 239/567; 134/166 C

(58) Field of Classification Search ..... 239/222.11–222.19, 225.1, 237, 240, 263, 239/380–383, 101, 548, 556, 567; 134/166 C, 134/167 C See application file for complete search history.

(56) References Cited

U.S. PATENT DOCUMENTS

| | | | | |
|---|---|---|---|---|
| 3,120,346 | A * | 2/1964 | Willhoite | 239/240 |
| 3,506,196 | A * | 4/1970 | Ramsey | 239/237 |
| 3,791,584 | A * | 2/1974 | Drew et al. | 239/237 |
| 3,872,533 | A | 3/1975 | Proffit et al. | |
| 6,193,169 | B1 | 2/2001 | Steinhilber et al. | |
| 2001/0017323 | A1 | 8/2001 | Feller et al. | |

FOREIGN PATENT DOCUMENTS

| | | | |
|---|---|---|---|
| CN | 85107997 | A | 4/1987 |
| FR | 2804886 | A1 | 8/2001 |

* cited by examiner

*Primary Examiner*—Steven J Ganey
(74) *Attorney, Agent, or Firm*—Sughrue Mion, PLLC

(57) ABSTRACT

The device comprises a liquid flow conduit (12), a rotating nozzle (14), which is mounted on a liquid discharge opening (20) of the flow conduit (12) so as to rotate, the rotating nozzle (14) being penetrated by at least one opening (32, 33, 34) for spraying a liquid, a wall (48) for distributing the liquid extending transversely in the flow conduit (12) over the entire cross-section of flow, the wall (48) for distributing the liquid being penetrated by a central conduit (56) for generating a central jet, and at least one tangential conduit (60) for generating at least one tangential jet in the direction of a drive axis, and a wall (50) for driving the nozzle (14), which extends opposite the wall (48) for distributing the liquid and is penetrated by at least one conduit (64) for receiving the or each tangential jet in order to rotationally drive the nozzle.

The drive wall (50) is rotationally engaged with the nozzle (14).

11 Claims, 3 Drawing Sheets

DEVICE FOR SPRAYING A LIQUID

BACKGROUND OF THE INVENTION

The present invention relates to a device for spraying a liquid.

A device of this type is used in particular with a cleaning liquid for sterilizing walls, for example in a machine for filling bottles.

A device for spraying a liquid of the type comprising:

a liquid flow conduit, delimiting a liquid intake opening and a liquid discharge opening, a rotating nozzle mounted so as to rotate about an axis of rotation on the liquid discharge opening of the flow conduit, the rotating nozzle being penetrated by at least one opening for spraying liquid positioned along a spray axis, which forms a non-zero angle with the axis of rotation, a wall for distributing the liquid, extending transversely in the conduit over its entire cross-section of flow so as to collect all of the liquid entering the flow conduit, the wall for distributing the liquid being penetrated:

by a central conduit to generate a central jet in the direction of the axis of rotation, and at least one tangential conduit to generate at least one tangential jet in a drive axis which does not intersect the axis of rotation, and a wall for driving the nozzle, which extends opposite the wall for distributing the liquid and is penetrated by at least one conduit for receiving the or each tangential jet in order to set the nozzle into rotation is known from the prior art.

In the prior art, the flow conduit is a cylinder of which the central direction is the axis of rotation. The wall for distributing the liquid is a disk which is integral with the flow conduit during operation of the device. Two tangential conduits are provided in said disk symmetrically about the axis of rotation.

The drive wall is disk mounted so as to rotate about the axis of rotation and having radial clearance allowing it to be displaced laterally relative to said axis. The receiving conduits are grouped together on the same side of the disk, that is to say they are distributed over an arc with an angle of less than 180°.

During operation of the device, the receiving conduits alternately receive the tangential jets generated by each of the two tangential conduits. When the receiving conduits pass in front of a tangential conduit, the drive disk is displaced laterally to the side of said tangential conduit due to the lateral clearance.

The nozzle comprises a peripheral drive finger which is integral with the nozzle and extends parallel to the axis of rotation to the periphery of the drive disk. When the drive disk is displaced laterally to the side where the finger is located, it comes into contact with said finger and briefly sets the nozzle into rotation.

One drawback of the prior art is that the nozzle therefore turns in a jerky manner. In addition, when the drive finger is not in contact with the nozzle, the energy provided by the liquid in the tangential jets is lost.

SUMMARY OF THE INVENTION

The object of the invention is to remedy said drawbacks by proposing a device for spraying a liquid of the aforementioned type, characterized in that the drive wall is rotationally engaged with the nozzle.

A device according to the invention may also comprise one or more of the following features:

the drive wall is rigidly connected to the nozzle;

it comprises at least one key for locking in rotation which extends parallel to the axis of rotation at a distance therefrom, the key being engaged at one end in a first locking aperture provided for this purpose in the nozzle and, at the other end, in a second locking aperture provided for this purpose in the drive wall;

the drive wall is penetrated by a plurality of receiving conduits positioned parallel to the axis of rotation and uniformly distributed in a circle around said axis;

the wall for distributing the liquid is penetrated by a plurality of tangential conduits which are distributed uniformly in a circle around the axis of rotation and open out opposite the receiving conduits;

each tangential conduit delimits a liquid discharge area, the circumference of which around the axis of rotation is greater than the circumferential distance separating two successive receiving conduits around the axis of rotation;

two circular ribs are provided on the drive wall in the direction of the wall for distributing the liquid, the receiving conduits being provided between the ribs;

the parity of the number of tangential conduits is different to the parity of the number of receiving conduits; and four tangential conduits and nine receiving conduits are provided.

BRIEF DESCRIPTION OF THE DRAWINGS

A clearer understanding of the invention will be facilitated by the following description, given solely by way of example and made in reference to the appended drawings, in which.

DETAILED DESCRIPTION OF THE INVENTION

Figure 1:
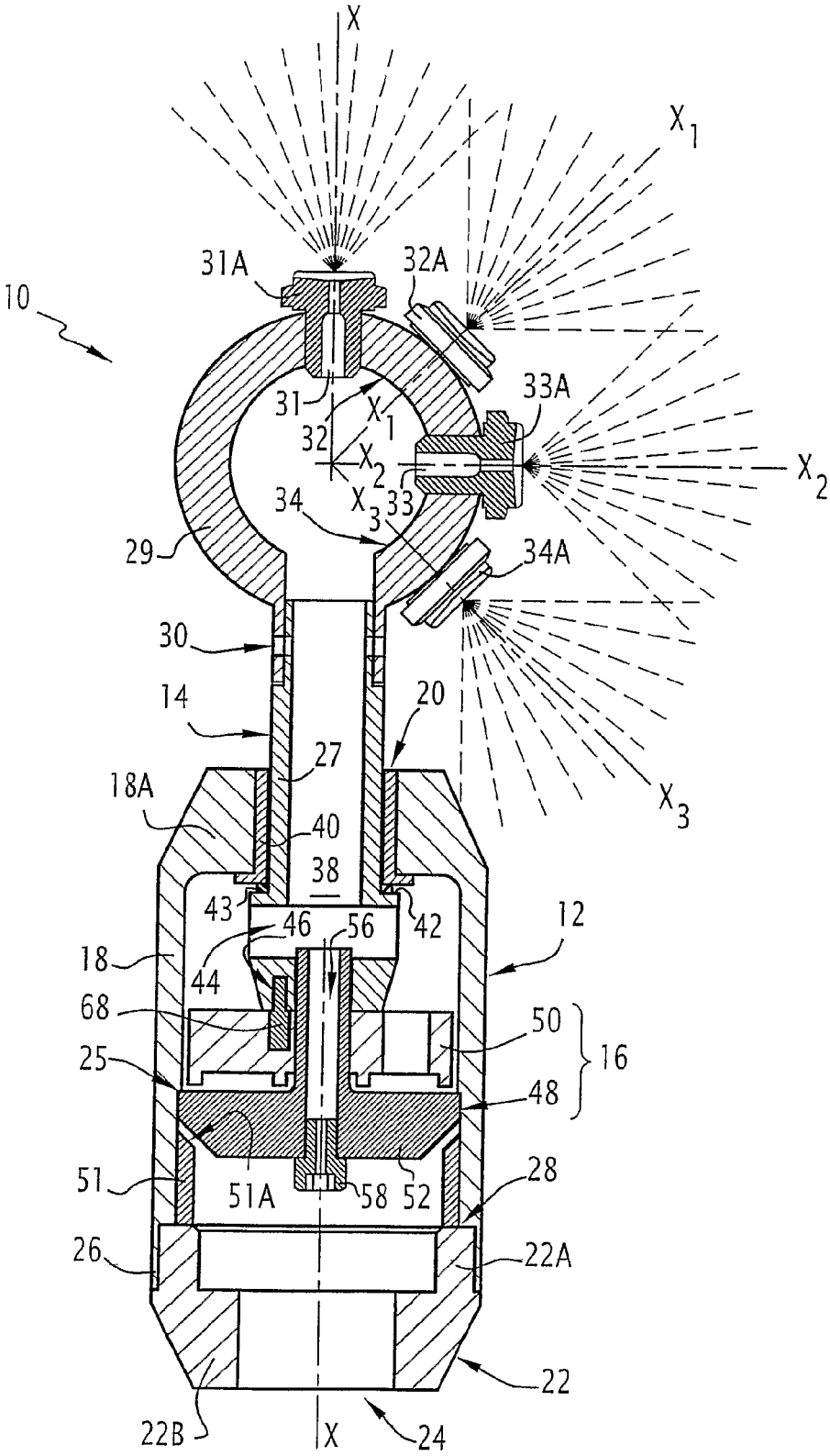
FIG. 1 is a longitudinal section along an axis of rotation of a device for spraying a liquid according to the invention.

The spray device shown in FIG. 1 is denoted with the general reference numeral 10.

It comprises a liquid flow conduit 12, a nozzle 14 rotating about an axis of rotation X-X, and means 16 for driving the nozzle 14 relative to the flow conduit 12.

The flow conduit 12 comprises a hollow cylindrical member 18 having an axis X-X. The member 18 is closed at one end by a transverse wall 18A. The wall 18A is penetrated by a circular opening 20 for discharging liquid which is centered on the axis of rotation X-X.

A first circular shoulder 25 is provided on the inner surface of the member 18 by internally reaming the end 26 of the body 18 remote from the wall 18A.

The flow conduit 12 also comprises a cap 22 which closes the opposite end 26. The cap 22 comprises a cylindrical wall 22A and a wall 22B forming the base of the cap. A circular opening 24 for intaking liquid, which is centered on the axis of rotation X-X, is provided in the wall 22B.

The cylindrical wall 22A of the cap 22 is thicker than the lateral wall of the member 18 and sprays into the interior, forming a second shoulder 28 opposite the first shoulder 25.

The rotating nozzle 14 comprises a tube 27, which passes through the opening 20 for discharging liquid, and a ball 29 for spraying liquid, which is fitted on an end of the tube 27 projecting out of the flow conduit 12. The ball 29 and the tube 27 are connected to one another by a pin (not shown) passing through them by means of a transverse hole 30.

The spray ball 29 is penetrated by four openings 31, 32, 33, 34 for spraying liquid. One 31 of the spray openings, referred to as the central spray opening, is positioned in accordance with the axis of rotation X-X, whereas the other three openings 32, 33, 34, referred to as oblique spray openings, are positioned in accordance with a respective spray axis $X_1$-$X_1$, $X_2$-$X_2$, $X_3$-$X_3$, forming a non-zero angle with the axis of rotation X-X. In the example shown, the spray axes form an angle of 45°, 90° and 135° respectively with the axis of rotation X-X.

A spray head 31A, 32A, 33A, 34A is plugged into each spray opening 31, 32, 33, 34. Each head is hollow and reamed in a manner suitable for generating a desired type of liquid spray. In the example shown, the liquid is sprayed in a conical manner. The central spray opening 31 and the spray opening 33 at 90° are shown in cross-section in FIG. 1. The two other openings 32, 34 are offset towards the front and towards the rear respectively of this sectional plane. For reasons of clarity, the heads 32A, 34A disposed on said openings have been drawn in solid lines in the sectional plane. One 34 of the openings is positioned in such a way that the liquid correspondingly spraying from the head 34A reaches the flow conduit 12 in order to be able to clean said conduit.

The tube 27 delimits a main conduit 38 along the axis of rotation X-X to guide the liquid from the member 18 towards the spray ball 29, via the discharge opening 20.

A plastics material ring 40 is inserted in the opening 20 between the transverse wall 18A and the tube 27 in order to limit the friction between said two elements. The end of the tube 27 located in the interior of the flow conduit 12 widens so as to form an annular projection 42 intended to rest on the ring 40 by means of a plastics material loop 43 pulled onto the tube 27. A diametral conduit 44, which is perpendicular to the axis of rotation X-X and passes through the main conduit 38, also penetrates right through said inner end.

In addition, three cylindrical apertures 46 for locking the key are provided on the edge of said lower end. This aspect of the device 10 will be explained further.

The means 16 for driving the nozzle comprise a wall 48 for distributing the liquid introduced via the intake opening 24, and a wall 50 for driving the nozzle 14.

A retaining ring 51 of the distribution wall 48 is applied against the member 18 and rests on the second shoulder 28 of the cap 22. Said retaining ring forms a new shoulder 51A opposite the shoulder 25.

Figure 2:
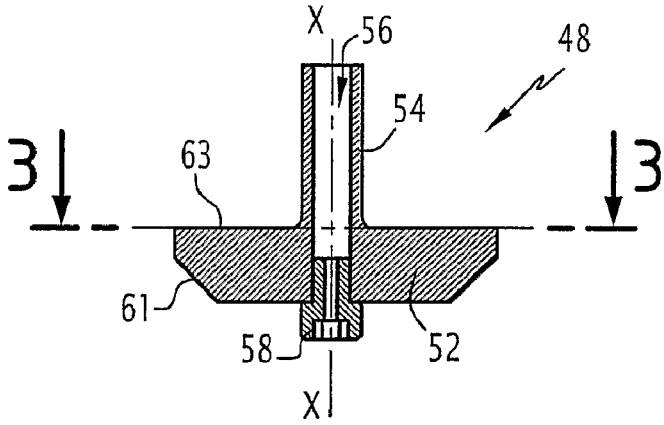
FIG. 2 is a sectional view similar to that of FIG. 1 of the wall for distributing the liquid of the device.
Figure 3:
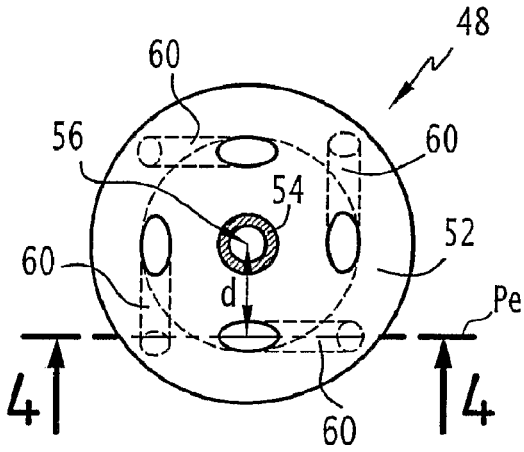
FIG. 3 is a cross-section of the distribution wall along the line 3-3 in FIG. 2.
Figure 4:
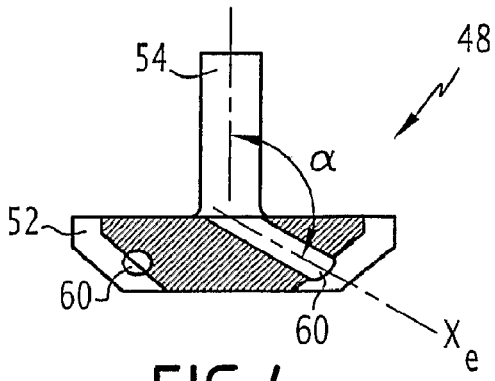
FIG. 4 is a longitudinal section, offset from the axis of rotation, of the distribution wall along the line 4-4 in FIG. 3.

The distribution wall 48, only shown in FIG. 2 to 4, firstly comprises a disk 52 which is delimited between the shoulders 25 and 51A and is intended to press against the first shoulder 25 of the member 18 during operation. A hole passes completely through the centre of the disk 52 along the axis of rotation X-X. A hollow shaft 54 rises around said hole along the axis of rotation X-X. The shaft 54 penetrates into the main conduit 38. The disk 52 and the shaft 54 thus delimit a central conduit 56 intended to generate a jet in the main conduit 38 in the direction of the axis of rotation X-X.

The distribution wall 48 also comprises a calibrated orifice 58 which is screwed into the central conduit 56 and faces the opening 24 for intaking liquid. The inner diameter of said orifice allows the fluid intake area in the central conduit 56 to be defined precisely.

With reference to FIGS. 3 and 4, the disk 52 is also penetrated by four tangential conduits 60 which open out at a distance from the axis of rotation X-X.

The tangential conduits 60 are rectilinear along a respective axis, referred to as the drive axis $X_e$-$X_e$. Each tangential conduit 60 extends from an intake face 61 in the form of a truncated cone of the wall 48 to a planar discharge face 63 of said wall. The drive axis $X_e$-$X_e$ of each tangential conduit is contained in a plane $P_e$ which is parallel to the axis of rotation X-X and is located at the same distance d from said axis X-X. The drive axis $X_e$-$X_e$ forms a non-zero angle $\propto$, of approximately 135°, with the projection of the axis of rotation X-X in the plane (FIG. 4).

The tangential conduits 60 are uniformly distributed around the axis of rotation X-X, that is to say each tangential conduit 60 corresponds to the preceding tangential conduit and is rotationally offset by a constant angle. This angle is 90° in the example shown.

Each tangential conduit 60 is thus capable of generating a tangential jet in the corresponding direction of the drive axis from the liquid introduced by the intake opening 24.

Each tangential conduit 60 delimits a liquid discharge area, the centre of which is located at a distance from the axis of rotation. In the example shown, the centre is located at the point in the plane $P_e$ closest to the axis of rotation X-X, that is to say at the distance d from said axis X-X.

In addition, each tangential conduit 60 delimits a liquid intake area. The ratio between the intake areas of the tangential conduits and the intake area of the calibrated opening 58 is selected in such a way that the tangential jets generated drive the nozzle 14 at a constant predetermined rotational speed of approximately several rotations per minute as a function of the liquid throughput provided through the opening 24.

Referring to FIG. 1 to 5, the drive wall 50 is in the form of a disk which extends opposite the planar discharge face 63 of the disk 52 of the distribution wall 48, between said disk 52 and the nozzle 14.

For this purpose, a conduit 62 for guiding and allowing the shaft 54 to pass therethrough passes completely through the drive wall 50 along the axis of rotation X-X. The drive wall 50 is thus mounted so as to rotate about the shaft 54. The diameter of said disk is slightly smaller than the inner diameter of the member 18 in order to allow it to rotate in said member.

A plurality of conduits 64 for receiving the tangential jets also pass completely through the drive wall 50.

There are nine conduits 64 in the example shown. The receiving conduits 64 are rectilinear and are positioned parallel to the axis of rotation X-X. They are distributed uniformly in a circular manner around the axis of rotation X-X. The centre of said conduits is located substantially at the distance d from the axis of rotation X-X, which corresponds to the distance d between the centre of the exit of each tangential conduit from the same axis of rotation X-X.

Three cylindrical apertures 66 are also provided along the axis X in the drive wall 50, each aperture 66 opening out opposite the tube 27 so as to be able to be aligned with one of the apertures 46 of the nozzle 14.

With reference to FIG. 1, the device 10 comprises three keys 68 for blocking in rotation which extend parallel to the axis of rotation X-X at a distance from said axis. Only one key 68 is shown in FIG. 1. Each key 68 is engaged at one end in one of the locking apertures 46 provided for this purpose in the nozzle 14 and, at the other end, in one of the complementary locking apertures 66 opposite in the drive wall 50.

In a variant, the wall 50 is rigidly connected to the nozzle 14, for example by force-fitting the keys 68.

Figure 5:
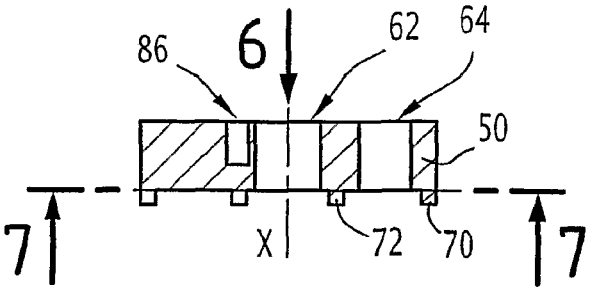
FIG. 5 is a longitudinal section of the wall for driving a rotating nozzle.
Figure 6:
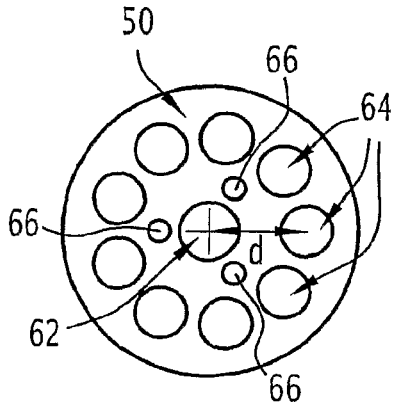
FIGS. 6 and 7 are a plan view and a view from below of the drive wall, in the direction 6 and along the line 7-7 respectively.
Figure 7:
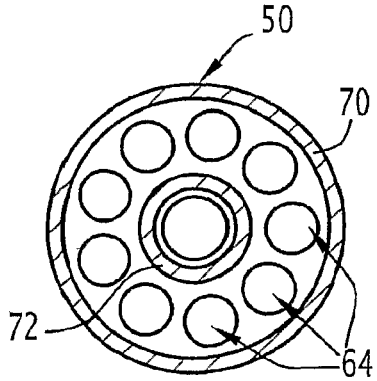

With reference to FIGS. 5 and 7, the first and second circular ribs 70, 72 are provided on the drive wall 50 in the direction of the distribution wall 48. The receiving conduits are disposed between the ribs 70 and 72. The first rib 70 thus extends around the periphery of the drive wall 50 to the exterior of the receiving conduits 64. The second rib 72 extends between the conduit 62 for guiding and allowing the shaft 54 to pass therethrough and the receiving conduits 64.

Figure 8:
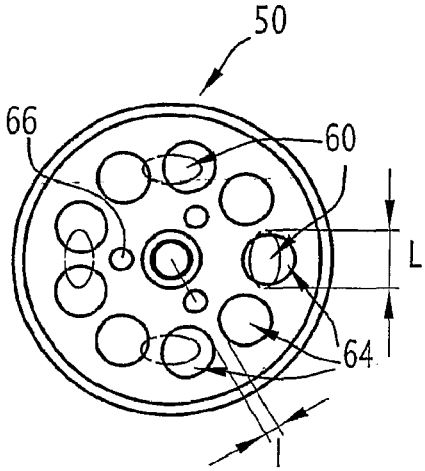
FIG. 8 is a plan view of the distribution wall and the drive wall superimposed on one another.

With reference to FIG. 8, it is shown that the liquid discharge area of each tangential conduit 60 has a circumference L around the axis of rotation X-X, that is to say, tangential to the geometric circle which has a radius d and is centered on the axis of rotation X-X, which is greater than the distance l between two successive receiving conduits around the axis of rotation X-X. A tangential jet is therefore always received, at least in part, by a receiving conduit 64.

The operation of the device 10 for spraying liquid will now be described.

When any liquid is introduced via the opening 24, the nozzle 14, the distribution wall 48 and the drive wall 50 are free to move slightly along the axis X. In particular, the wall 48 is capable of moving axially between the shoulder 25 and the retaining ring 51.

Cleaning liquid is introduced via the intake opening 24. Said liquid pushes the distribution wall 48 against the shoulder 25. The entrances of the tangential conduits 60 are thus freed, that is to say they are no longer covered by the ring 51. The friction between the shoulder 25 and the distribution wall 48 prevents said wall 48 rotating about the axis of rotation X-X.

The liquid introduced subsequently passes through the distribution wall 48 via the central conduit 56 and via the tangential conduits 60. On the one hand, a central jet is formed in the direction of the axis of rotation X-X and four tangential jets flowing from each tangential conduit 60 are formed in the direction of the corresponding drive axis. The central jet is directed directly into the main conduit 38 of the nozzle 14.

The tangential jets are directed towards the space between the two circular ribs of the driving wall 50. Said jets are thus directed onto the receiving conduits 64 and the risk of liquid passing to the periphery of the drive wall 50 between said wall 50 and the member 18 is low. The liquid of the tangential jets passing into the receiving conduits 64 causes the drive wall 50 to rotate about the axis of rotation X-X, said drive wall in turn driving the nozzle 14 due to the keys 68.

After having passed through the drive wall 50, the liquid, sprayed in the form of tangential jets, reaches the body 18 of the flow conduit 12 before rejoining the central jet in the main conduit 38 by passing through the diametral conduit 44.

The cleaning liquid is thus conveyed in its entirety by the main conduit 38 into the ball 29, from which it will be sprayed to the exterior by means of the spray heads 31A, 32A, 33A and 34A.

Due to the invention, the drop in pressure caused by rotationally driving the nozzle is low in such a way that the spray pressure is close to the supply pressure, in contrast to the nozzles of the prior art in which the supply pressure substantially acts to rotate the nozzle. Since the energy of the tangential jets is used both for rotating the nozzle 14 and for creating the spray pressure, there is no loss of energy. In addition, contrary to the known nozzles, in which rotational speed is a function of the supply pressure, the rotational speed of the nozzle according to the invention may be adjusted in such a way that it turns regularly about the axis of rotation X-X; this is achieved by adjusting the intake area of the calibrated orifice 58.

The invention claimed is:

1. A device for spraying a liquid of the type comprising:

a liquid flow conduit, delimiting a liquid intake opening and a liquid discharge opening, the liquid discharge opening defining an axis of rotation, a rotating nozzle mounted so as to rotate about the axis of rotation on the liquid discharge opening of the flow conduit, the rotating nozzle defining at least one opening for spraying liquid positioned along a spray axis, which forms a non-zero angle with the axis of rotation, a central conduit, at least one tangential conduit, and a wall for distributing the liquid, the wall extending transversely in the flow conduit over the entire cross-section of flow of the flow conduit so as to collect all of the liquid entering the flow conduit, the wall for distributing the liquid being penetrated:

by the central conduit to generate a central jet in the axis of rotation, and by the at least one tangential conduit to generate at least one tangential jet in a drive axis which does not intersect the axis of rotation, and a drive wall for driving the nozzle which extends opposite the wall for distributing the liquid, the drive wall being penetrated by a plurality of receiving conduits for receiving the or each tangential jet in order to set the nozzle into rotation, wherein the drive wall is rotationally engaged with the nozzle, the central conduit leads to the nozzle to generate the central jet inside the nozzle, the plurality of receiving conduits are positioned parallel to the axis of rotation and are distributed uniformly in a circle around said axis, and two circular ribs are provided on the drive wall, in the direction of the wall for distributing the liquid, the receiving conduits being provided between the two circular ribs.

2. The device as claimed in claim 1, wherein the drive wall is rigidly connected to the nozzle.

3. The device as claimed in claim 2, wherein the device comprises at least one key for locking in rotation which extends parallel to the axis of rotation at a distance from said axis, the key being engaged at one end in a first locking aperture provided for this purpose in the nozzle and, at the other end, in a second locking aperture provided for this purpose in the drive wall.

4. The device as claimed in claim 3, wherein the device includes a plurality of tangential conduits, the wall for distributing the liquid being penetrated by the plurality of tangential conduits which are distributed uniformly in a circle around the axis of rotation and open out opposite the receiving conduits.

5. The device as claimed in claim 2, wherein the device includes a plurality of tangential conduits, the wall for distributing the liquid being penetrated by the plurality of tangential conduits which are distributed uniformly in a circle around the axis of rotation and open out opposite the receiving conduits.

6. The device as claimed in claim 1, wherein the device comprises at least one key for locking in rotation which extends parallel to the axis of rotation at a distance from said axis, the key being engaged at one end in a first locking aperture provided for this purpose in the nozzle and, at the other end, in a second locking aperture provided for this purpose in the drive wall.

7. The device as claimed in claim 6, wherein the device includes a plurality of tangential conduits, the wall for distributing the liquid being penetrated by the plurality of tangential conduits which are distributed uniformly in a circle around the axis of rotation and open out opposite the receiving conduits.

8. The device as claimed in claim 1, wherein the device includes a plurality of tangential conduits, the wall for distributing the liquid being penetrated by the plurality of tangential conduits which are distributed uniformly in a circle around the axis of rotation and open out opposite the receiving conduits.

9. The device as claimed in claim 8, wherein each tangential conduit delimits a liquid discharge area, the circumference of which around the axis of rotation is greater than the circumferential distance around the axis of rotation separating two successive receiving conduits.

10. The device as claimed in claim 1, wherein the parity of the number of tangential conduits differs from the parity of the number of receiving conduits.

11. The device as claimed in claim 10, wherein four tangential conduits and nine receiving conduits are provided.

* * * * *